US005383558A

United States Patent [19]

Wilkinson et al.

[11] Patent Number: 5,383,558

[45] Date of Patent: Jan. 24, 1995

[54] SEALED CONTAINER

[75] Inventors: Roger D. Wilkinson, New Fairfield, Conn.; Dean R. Lindsay, Winnetka, Ill.

[73] Assignee: Kraft General Foods, Inc., Northfield, Ill.

[21] Appl. No.: 943,959

[22] Filed: Sep. 11, 1992

[51] Int. Cl.[6] ..... B65D 81/02

[52] U.S. Cl. ..... 206/508; 206/497; 206/509; 215/344; 215/354; 215/1 C; 215/329; 215/251; 220/304; 220/675

[58] Field of Search ..... 215/344, 354, 356, 1 C, 215/329, 228, 251, 252; 220/288, 304, 669, 672, 675; 206/497, 508, 509

[56] References Cited

U.S. PATENT DOCUMENTS

| | | | |
|---|---|---|---|
| 2,768,762 | 10/1956 | Guinet . | |
| 2,829,790 | 4/1958 | Isele-Aregger . | |
| 3,074,579 | 1/1963 | Miller | 215/384 X |
| 3,389,851 | 6/1968 | Clark | 206/508 X |
| 3,441,161 | 4/1969 | Van Baarn . | |
| 3,568,871 | 3/1971 | Livingstone . | |
| 3,603,472 | 9/1971 | Lecinski et al. . | |
| 3,811,591 | 5/1974 | Novitch | 215/215 X |
| 4,383,620 | 5/1983 | Mumford . | |
| 4,442,947 | 4/1984 | Banich, Sr. . | |
| 4,450,960 | 5/1984 | Johnson | 206/508 X |
| 4,560,077 | 12/1985 | Dutt | 215/307 |
| 4,566,603 | 1/1986 | Moore | 215/329 |
| 4,598,835 | 7/1986 | Brownbill . | |
| 4,768,672 | 9/1988 | Pulciani et al. | 206/508 X |
| 4,856,668 | 8/1989 | Pfefferkorn et al. . | |
| 4,907,709 | 3/1990 | Abe et al. | 215/252 |
| 4,928,839 | 5/1990 | Kruelskie | 206/508 |
| 4,977,002 | 12/1990 | Hoffman . | |

FOREIGN PATENT DOCUMENTS

| | | |
|---|---|---|
| 38214 | 5/1968 | Australia . |
| 176205 | 4/1986 | European Pat. Off. . |
| 423406 | 4/1991 | European Pat. Off. . |
| 2431432 | 2/1980 | France . |

*Primary Examiner*—Gary E. Elkins
*Assistant Examiner*—Stephen Cronin
*Attorney, Agent, or Firm*—Thomas R. Savoie; Thomas A. Marcoux

[57] ABSTRACT

A sealed container includes a base jar for containing a substance and a removable lid for closing and sealing the base jar. The base jar includes a bottom wall, a side enclosure extending upwardly from the bottom wall having an upper portion with a screw thread, and an upper wall extending inwardly and upwardly from the upper portion of the side enclosure having a circular brim which defines a wide mouth opening for the base jar. The removable lid includes a top wall and an encircling member extending downwardly therefrom with a screw thread which matingly engages with the screw thread of the upper wall of the base jar. For sealing with the base jar, the removable lid also includes a circular projection extending downwardly from the lid which engages and seals with the circular brim. For additional sealing, the removable lid further includes a circular flexible flange extending downwardly from the lid having a tip which is radially flexed relative to a remainder of the flange upon engagement with the upper wall of the jar to seal therewith as the circular projection and circular brim matingly engage. Preferably, the top wall of the lid also includes a circular centering rim which, before engagement of the circular projection with the circular brim, engages an inside surface of the circular brim to positively locate the circular projection vertically adjacent the circular brim. A stacking mechanism is further provided so that the containers can be stacked one on top of another.

15 Claims, 5 Drawing Sheets

SEALED CONTAINER

FIELD OF THE INVENTION

The present invention relates generally to a sealed container with a replaceable lid for containing a substance to be protected from an outside environment, and more particularly to a sealed container having two positive seals and an easily replaceable lid.

BACKGROUND OF THE INVENTION

In the packaging of substances, it is frequently desired to protect the substance from the outside environment with a package, while still allowing intermittent access to the substance. For example, where the substance is fructose-containing powdered beverage mix, it is desired to package a number of servings of such a powdered mix in a single package. Thus, a mechanism must be provided with the package for periodic access when the user wishes to remove a serving. However, in the interim (which may be days or even much longer), it is equally important that the powdered mix be completely protected or sealed from moisture in the surrounding environment.

While various packages of this type have been proposed in the prior art, various drawbacks have existed with such packages. Among the drawbacks has been: incomplete sealing of the substances from the environment, difficult access mechanisms, hard to handle packages, and hard to reseal packages.

SUMMARY OF THE INVENTION

In accordance with the present invention, a sealed container which is easily opened and which positively seals a substance therein is provided. The container includes a base jar for containing the substance and a removable lid for closing and sealing the substance in the base jar. This lid is easily and quickly removed and replaced, and is easily and positively placed on the base jar to positively and completely seal the substance from the outside environment.

The base jar includes a bottom wall and a side enclosure extending upwardly from the bottom wall. This side enclosure includes an upper portion disposed radially about a central axis with a screw thread about the upper portion. The base jar also includes an upper wall extending inwardly and upwardly from the upper portion of the side enclosure and radially about the central axis. This upper wall includes a circular brim which defines a mouth opening for the jar.

The removable lid for the jar which seals the opening includes a top wall disposed about the central axis and an encircling member extending downwardly from the top wall and radially about the central axis. The encircling member includes a screw thread which matingly engages with the screw thread of the upper wall of the jar. For sealing with the base jar, the removable lid also includes a circular projection extending downwardly from the lid and radially about the central axis which engages and seals with the circular brim after the screw threads of the jar and lid engage. For additional sealing, the removable lid further includes a circular flexible flange extending downwardly from the lid and radially about the circular projection and the central axis. This flexible flange has a tip which is radially flexed relative to a remainder of the flange upon engagement with the upper wall of the jar to seal therewith as the circular projection and circular brim matingly engage.

In a preferred embodiment, the top wall of the lid includes a circular centering rim extending downwardly from the top wall and radially just inside and downwardly beyond the circular projection. Thus, before engagement of the circular projection with the circular brim, the centering rim engages an inside surface of the circular brim to positively locate the circular projection vertically adjacent and coaxial with the circular brim. Preferably, this centering rim includes a lower outside surface which is inclined downwardly and inwardly to aid in this centering action.

In the preferred embodiment, the container further includes a stacking means for stacking one container vertically on another. This stacking means includes, in the top wall of the lid, a top recess about the central axis and an outer downwardly bevelled portion thereabout. Then, in the bottom wall of the base jar, the stacking means includes a concavity having an exterior surface which mates with the bevelled portion of an underlying lid and stacking lugs projecting downwardly therefrom which are received inside of the top recess of the underlying lid.

In accordance with the preferred embodiment, the upper wall is curved to form a dome. Further, the circular brim has a diameter which is 50 to 80% of a diameter of the upper portion of the of the side enclosure, and most preferably about ⅔ of the diameter of the upper portion.

Also in accordance with the preferred embodiment, the side enclosure below the upper portion includes a holding recess therein and is cylindrically shaped. If desired, the encircling member includes an indicia which is used as a measuring mark.

It is an object of the present invention to provide a moisture-proof container which is easily opened and resealed.

It is also an object of the present invention to provide a container with redundant seals to assure that moisture does not enter the container.

It is a further object of the present invention to provide a container which is easy to produce, use and store.

Other features, advantages and objects of the present invention are stated in or apparent from the detailed description of a presently preferred embodiment of the invention found hereinbelow.

DETAILED DESCRIPTION OF THE PREFERRED EMBODIMENTS

Figure 1:
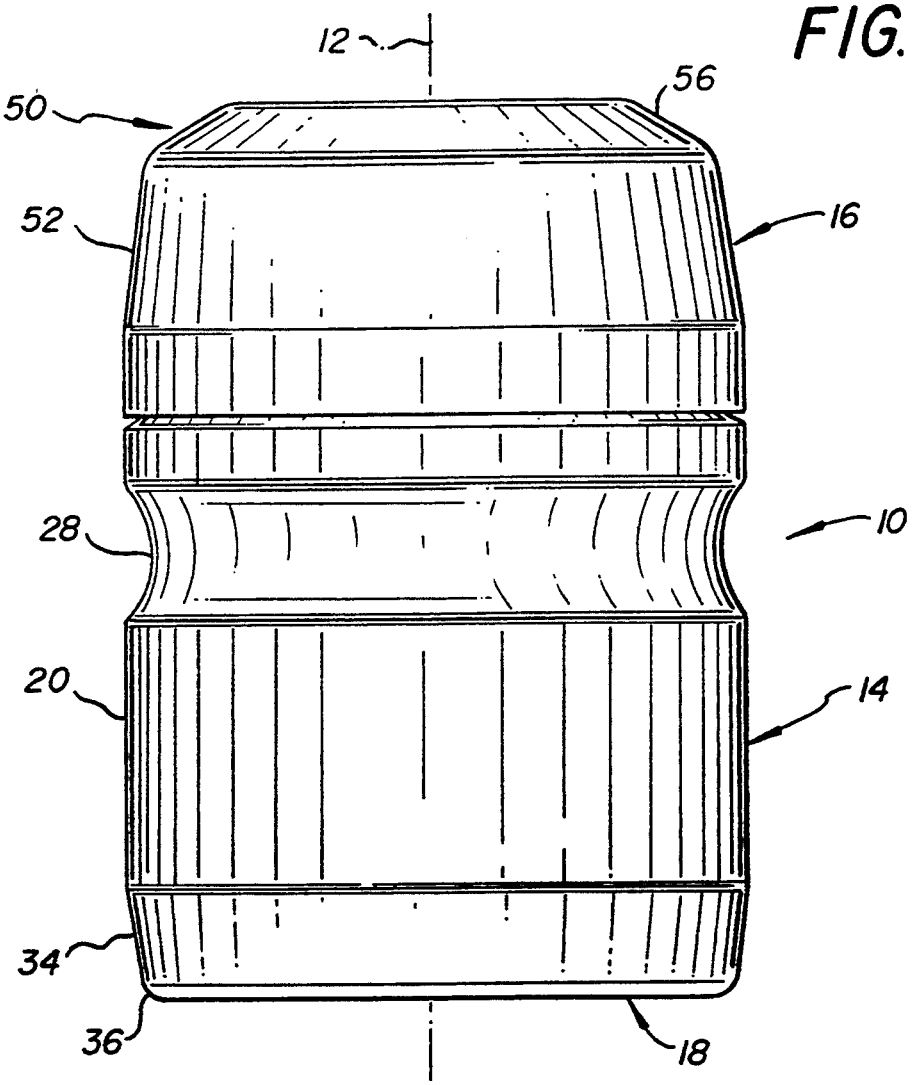
FIG. 1 is an elevation view of the container of the present invention comprised of a base jar and removable lid.
Figure 2:
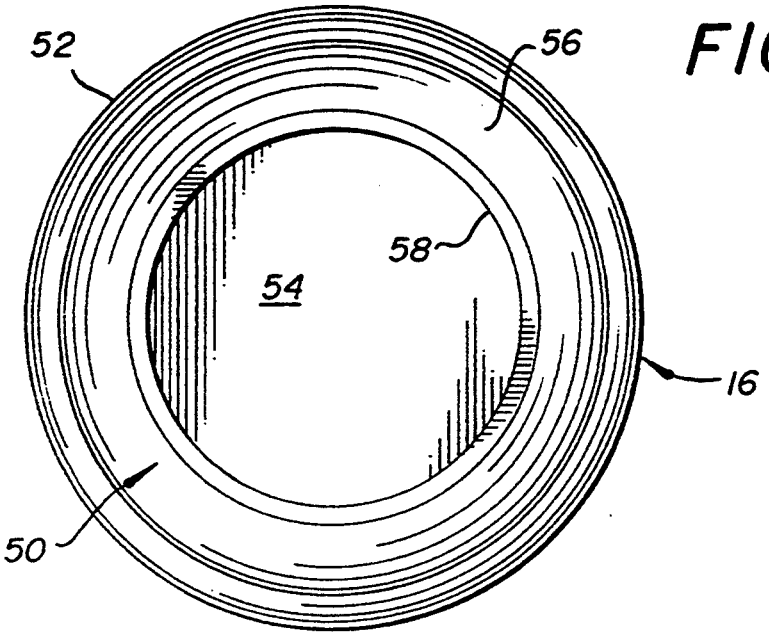
FIG. 2 is a top plan view of the container, and in particular of the lid thereof, depicted in FIG. 1.
Figure 3:
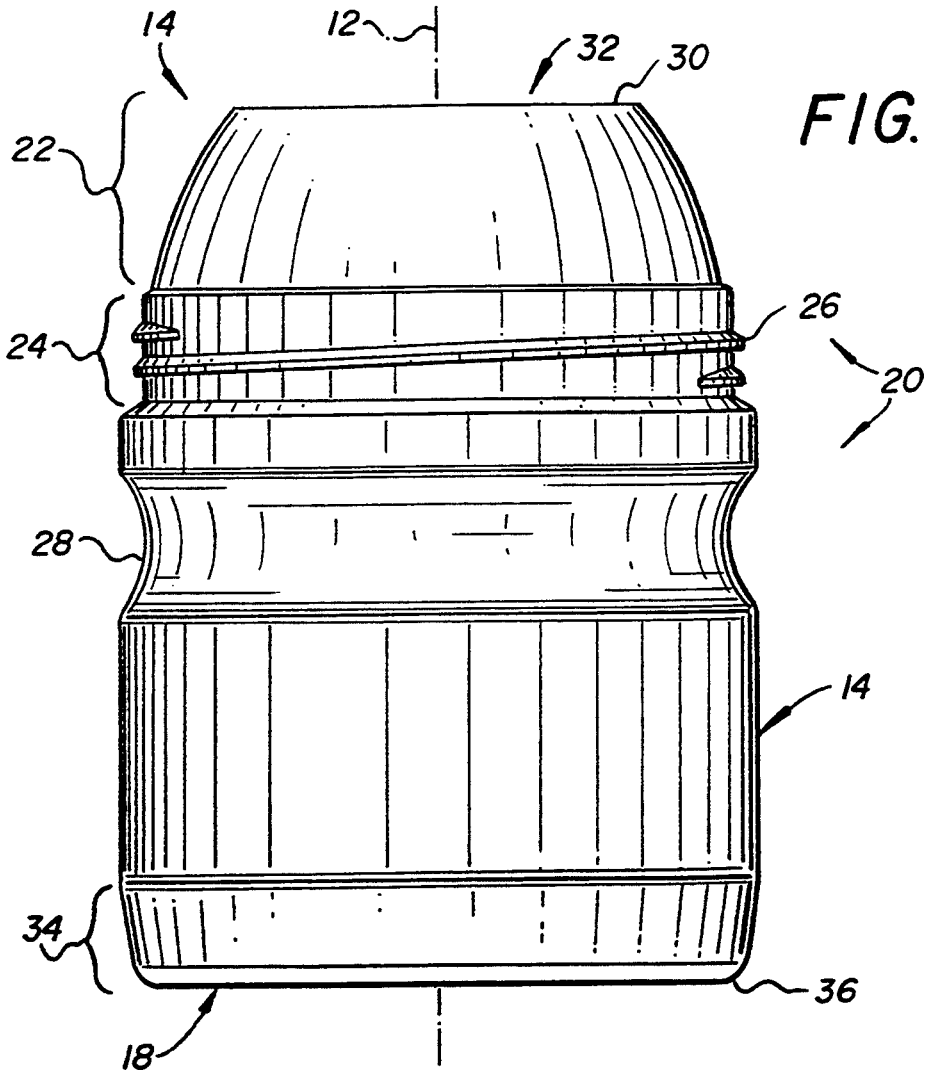
FIG. 3 is an elevation view of the base jar depicted in FIG. 1.
Figure 4:
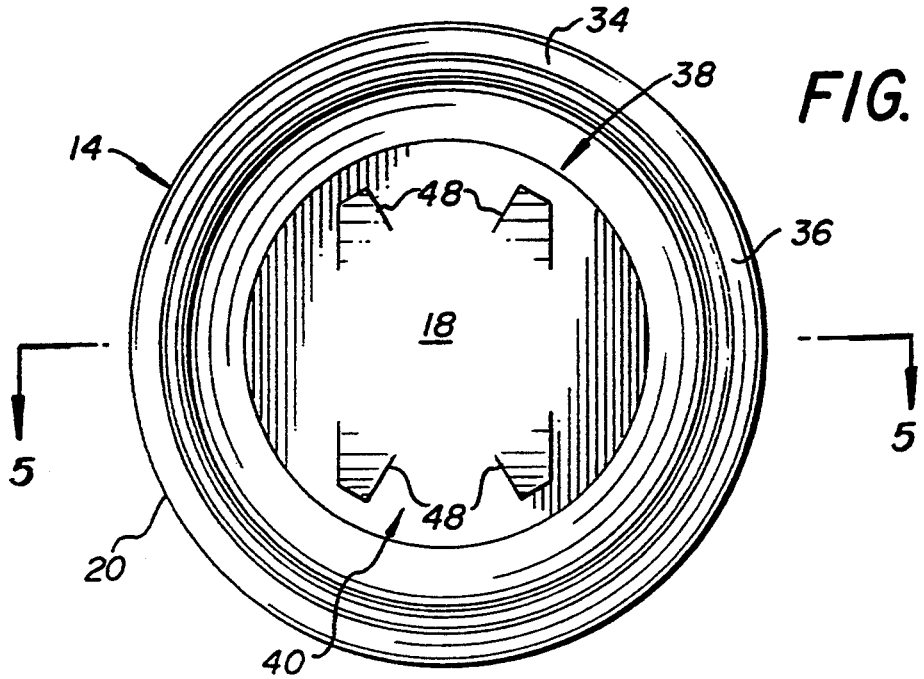
FIG. 4 is a bottom plan view of the container, and in particular of the base jar thereof, depicted in FIG. 1.

With reference now to the drawings in which like numerals represent like elements throughout the views, a sealed container 10 in accordance with the present invention is depicted in elevation in FIG. 1. Container 10 is broadly cylindrical in shape and is symmetrically formed radially about a central axis 12, although it will be apparent from the following description that portions could be other than radially symmetrical while others must be. It will also be appreciated that container 10 is comprised broadly of a base jar 14 which is used to contain some substance and a removable lid 16. In this preferred embodiment, the substance is preferably a fructose-containing powdered beverage mix, though obviously many other types of substances both solid, liquid, and liquid-like (i.e., powdered) could be contained. For convenience, base jar 14 and lid 16 are depicted separately and will thus be initially described separately.

As shown in greater detail in FIGS. 3–6, base jar 14 is broadly formed of a bottom wall 18, a side enclosure 20, and an upper wall 22. Side enclosure 20 extends upwardly from bottom wall 18 and includes an upper portion 24 having a screw thread 26 thereabout. Side enclosure 20 also includes a peripheral holding recess 28 formed as a curved concavity located below upper portion 24. Holding recess 28 provides a convenient location for a user to grasp base jar 14 (with or without lid 16), with holding recess 28 being sized to easily receive (on opposite sides thereof) the fingerprint area of a finger and thumb of the user. Base jar 14 is typically produced by blow molding techniques.

Upper wall 22 extends inwardly and upwardly from upper portion 24 and is curved to form a semi-spherical dome as shown. Upper wall 22 terminates at a circular brim 30 which has an inside surface 31 and which defines a mouth opening 32 for base jar 14. As container 10 is designed for a powdered beverage mix, it is desired for mouth opening 32 to be relatively wide to allow an easy pouring or removal of the beverage mix from base jar 14. For this reason, mouth opening 32 (defined by a diameter of circular brim 30) is preferably about 50 to 80% of a diameter of upper portion 24 (or the portion of side enclosure 20 therebelow), or more preferably about ⅔ of that diameter.

Figure 5:
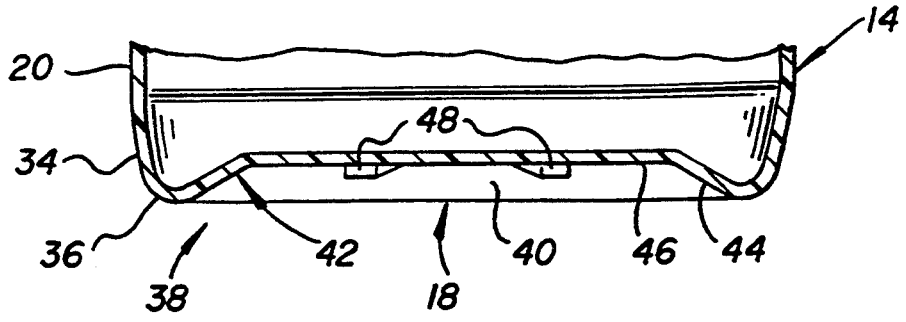
FIG. 5 is a cross-sectional elevation view taken along line 5—5 of the base jar depicted in FIG. 4.
Figure 6:
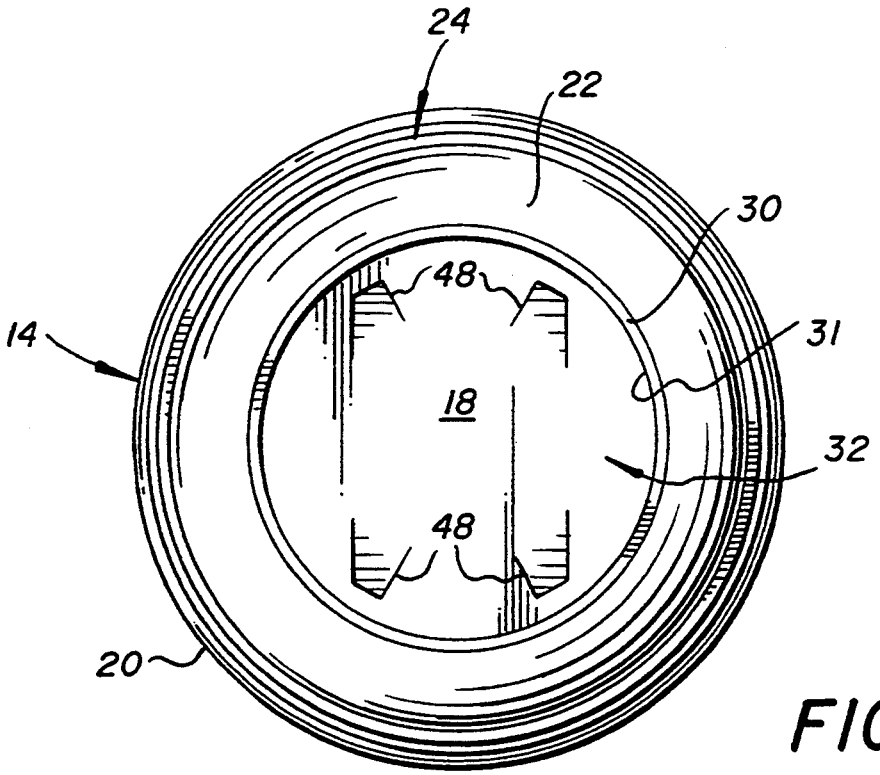
FIG. 6 is a top plan view of the base jar depicted in FIG. 3.
Figure 7:
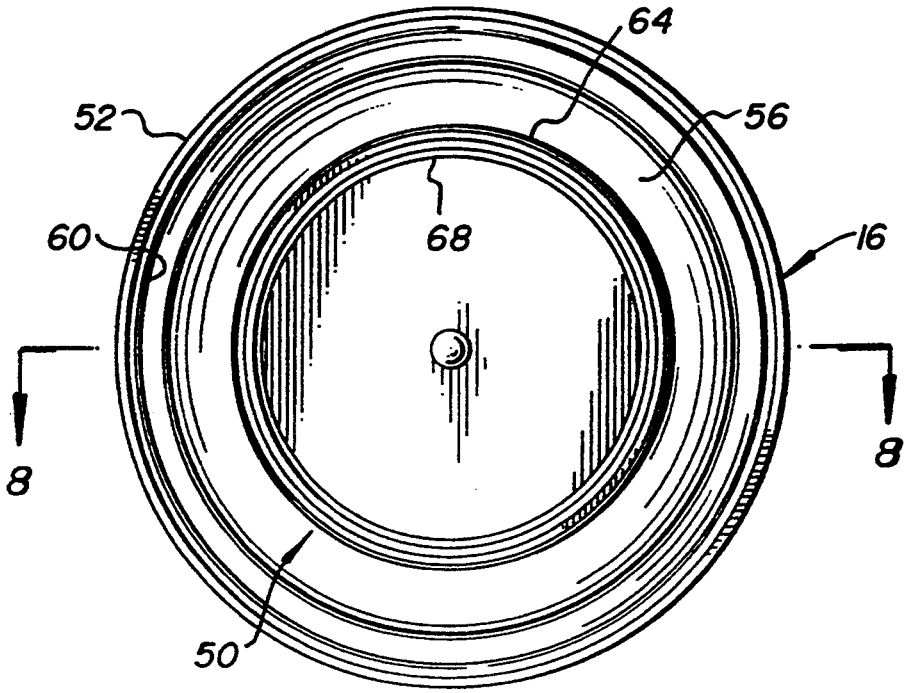
FIG. 7 is a bottom plan view of the lid depicted in FIG. 2.
Figure 8:
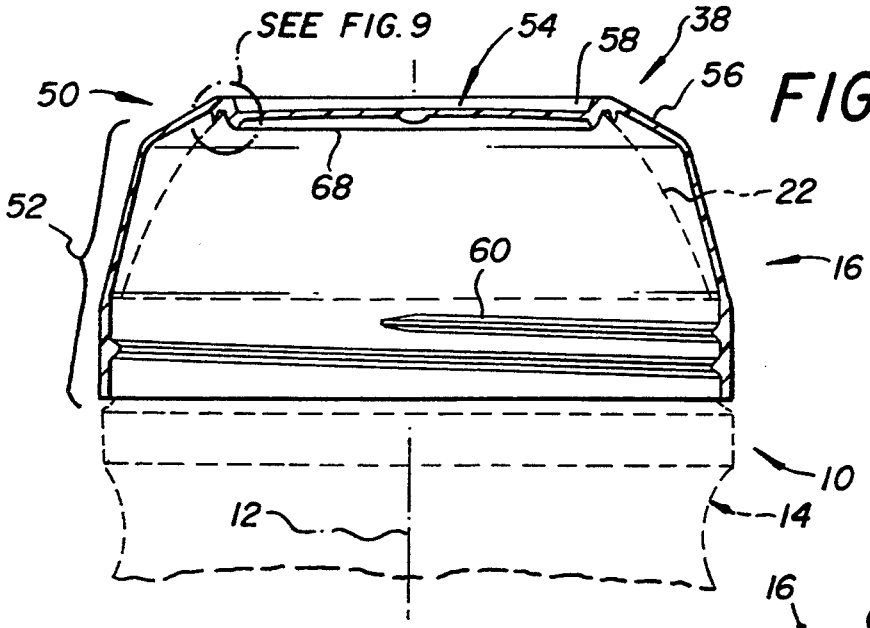
FIG. 8 is a cross-sectional elevation view taken along line 8—8 of the lid depicted in FIG. 7.

As shown best in FIG. 5, side enclosure 20 further includes a lower inclined portion 34 which joins bottom wall 18 at a rounded edge 36. Bottom wall 18 is then formed to create one half of a stacking means 38 by which one container 10 is easily stacked on top of another such container 10. (The other half of stacking means 38 is described subsequently with reference to lid 16.) Stacking means 38 includes a concavity 40 formed by bottom wall 18 having an exterior surface 42. In particular, it will be appreciated that exterior surface 42 includes an inclined surface 44 and a horizontal surface 46. In addition, stacking means 38 also includes stacking lugs 48 formed in bottom wall 18 and extending ramp-like as shown from horizontal surface 46 and terminating before inclined surface 44.

Depicted in greater detail in FIGS. 2 and 7–9 is lid 16. Lid 16 broadly includes a top wall 50 and an encircling member 52. Top wall 50 includes, as part of stacking means 38, a generally cylindrical (actually slightly frustoconical as shown) top recess 54 and an outer downwardly bevelled portion 56. It will thus be appreciated that exterior surface 42 (and particularly inclined surface 44) of bottom wall 18 of base jar 14 mates with bevelled portion 56 of an underlying container 10 to provide a nesting fit. Further, it will also be appreciated that stacking lugs 48 of bottom wall 18 are received within top recess 54 of top wall 50 of lid 16 to prevent too great of a sliding movement in any radial direction of base jar 14 relative to the underlying lid 16. The amount of sliding movement is thus approximately the separation distance of stacking lugs 48 from a cylindrical (slightly frustoconical) wall 58 of top recess 54. Lid 16 is typically produced by injection molding techniques in order to obtain mass production of lids within relatively close tolerances.

Encircling member 52 of lid 16 includes a screw thread 60 on an inside thereof as shown. It will be appreciated that screw thread 60 matingly engages with screw thread 26 of base jar 14 to removably hold lid 16 on base jar 14. It will also be appreciated that lid 16 may be conveniently used as a measuring receptacle or cup for the powdered beverage mix contained in base jar 14. Thus, lid 16 preferably includes a measuring indicia(s) along the inside surface thereof at the appropriate position. In this preferred embodiment, screw thread 60 suitably serves as an indicia of this sort so that the powdered beverage mix would be poured into an inverted lid 16 until reaching screw thread 60 in order to provide a proper amount of the beverage mix to make two quarts when added to water (for example). Obviously, other or different marks could be provided on the inside surface of lid 16 to serve as appropriate measuring marks.

Figure 9:
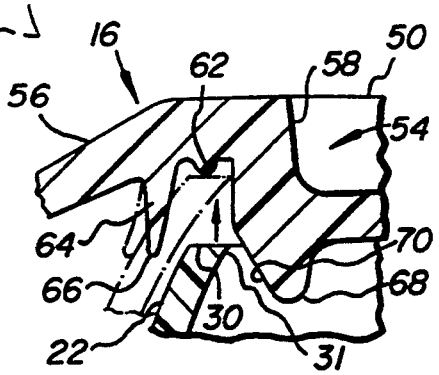
FIG. 9 is an enlarged view of the identified portion of the lid and base jar depicted in FIG. 8 as the lid is sealed to the base jar.

To provide a first sealing of mouth opening 32 of base jar 14, lid 16 includes a circular projection 62 extending downwardly therefrom as shown best in FIG. 9. After screw threads 26 and 60 engage to hold lid 16 on base jar 14 (the engagement of which has drawn base jar 14 and lid 16 toward one another, as shown by the arrow in FIG. 9), circular projection 62 matingly seals all the way around the central axis 12 with a flat topmost surface of circular brim 30 as shown in phantom in FIG. 9.

To provide a second (and hence redundant) sealing of mouth opening 32 of base jar 14, lid 16 also includes a circular flexible flange 64 extending downwardly from lid 16 radially about and downwards beyond circular projection 62. Flexible flange 64 tapers to a tip 66 as shown. Thus, as circular projection 62 and circular brim matingly engage (as screw threads 26 and 60 engage and bring base jar 14 and lid 16 toward one another), tip 66 is flexed radially outward relative to a remainder of flexible flange 64 by engagement with the portion of upper wall 22 immediately adjacent circular brim 30. This provides the second and redundant seal completely about mouth opening 32.

In order to assure the proper orientation (centering) of lid 16 on base jar 14 and hence the proper engagement of (a) circular projection 62 with circular brim 30 and (b) tip 66 with upper wall 22, lid 16 is also provided with a circular centering rim 68. Centering rim 68 assures that lid 16 is centered on base jar 14, and thus that circular projection 62 is in position to engage circular brim 30 and that flexible flange 64 is in position for tip 66 to engage upper wall 22. Centering rim 68 extends below both circular projection 62 and tip 66 of flexible flange 64 so as to engage inside surface 31 of circular brim 30 first to assure the accurate radial location of centering rim 68 and hence the remainder of lid 16. To ease this centering action and provide for some play, centering rim 68 includes a lower outside surface 70 which is inclined downwardly and inwardly as shown. Thus, if circular brim 30 is somewhat offset, circular brim 30 will ride along lower outside surface and be properly located when flexible flange 64 and circular projection 62 engage with circular brim 30 and upper wall 22.

Figure 10:
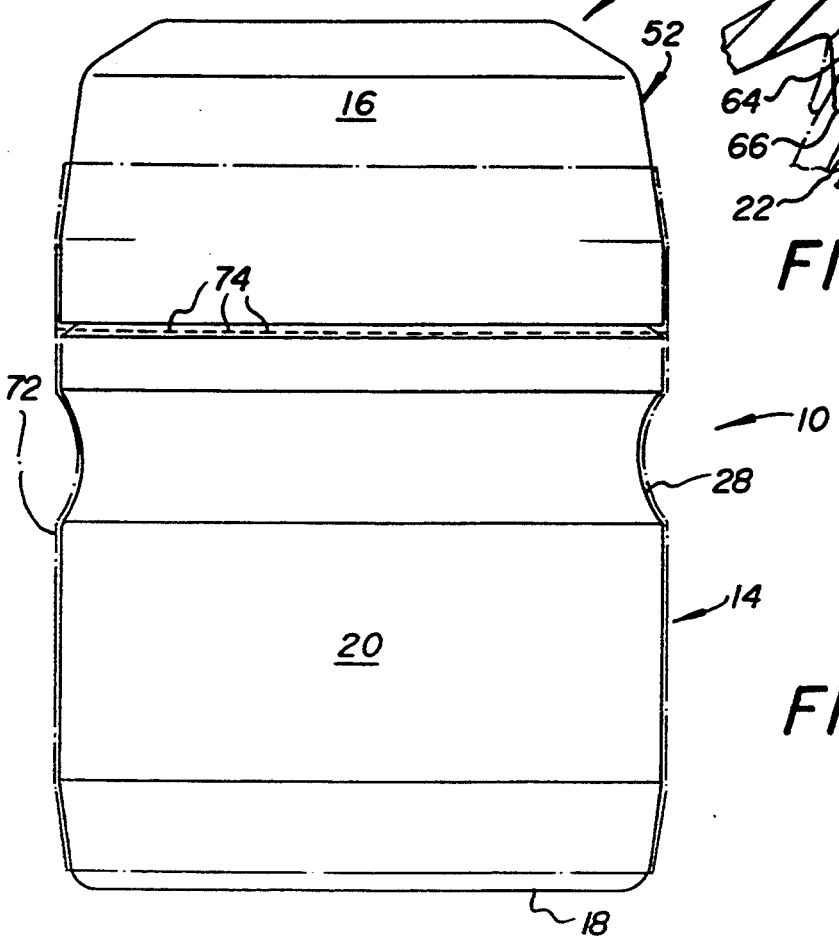
FIG. 10 is an elevational schematic view of the container depicted in FIG. 1 with a label attached thereto.

In order to secure lid 16 to base jar 14 after filling, a heat shrink label 72 is applied about container 10 as schematically depicted in FIG. 10. Heat shrink label 72 includes a line of perforations or slits 74 adjacent the gap provided between the bottom edge of lid 16 and side enclosure 20 of base jar 14 so that label 72 is easily broken at perforations 74 by twisting of lid 16 in order to open container 10. It will thus be appreciated that label 72 also serves as a tamper indicator so that container 10 cannot be opened without breaking label 72.

Label 72 is preferably applied to container 10 in the manner disclosed in U.S. Pat. No. 4,977,002 (Hoffman). It will be appreciated that label 72 extends vertically onto lower portion 34 of base jar 14 which slopes radially inward and vertically onto the portion of encircling member 52 which similarly slopes radially inward. Thus, once label 72 is shrunk onto container 10 at these sloping portions and also into holding recess 28, label 72 is positively locked or retained in position by the shrunk portions thereof at these (oppositely) inward sloping portions.

In use, container 10 is formed as a base jar 14 and lid 16 as described above and the desired substance deposited in base jar 14. Thereafter, lid 16 is applied to base jar 14 and heat shrunk label 72 applied to container 10. In this form, it will be appreciated that the substance in container 10 is doubly sealed by the engagement of circular projection 62 with circular brim 30 and the engagement of tip 66 of flexible flange 64 with upper wall 22 of base jar 14. Container 10 is thus suitable for boxing, shipping and displaying, and containers 10 are stackable one on top of another by use of stacking means 48 during these operations. Thereafter, the user simply opens container 10 by twisting lid 16 relative to base jar 14 to break label 72 at perforations 74. Once the desired amount of the substance inside of base jar 14 is removed, such as by using lid 16 as a measuring cup, lid 16 is re-screwed onto base jar 14 to effect the double sealing arrangement again.

Although the present invention has been described relative to a preferred embodiment thereof, it will be appreciated that other configurations consistent with the invention would be possible. For example, if desired, side enclosure 20 below upper portion 24 could be other than cylindrical, such as square. Similarly, this part of side enclosure 20 need not be formed about central axis 12 but could be offset if desired.

Thus, while the present invention has been described with respect to an exemplary embodiment thereof, it will be understood by those of ordinary skill in the art that variations and modifications can be effected within the scope and spirit of the invention.

What is claimed is:

1. A sealed container which is easily opened comprising:

a base jar for containing a powdered mix, said jar including a bottom wall, a side enclosure extending upwardly from said bottom wall and including an upper portion disposed radially about a central axis with a screw thread about said upper portion, a semi-spherical curved upper wall extending inwardly and upwardly from said upper portion of said side enclosure and radially about the central axis, said upper wall including a circular brim which defines a mouth opening for said jar, said circular brim having a diameter which is from 50 to 80% of a diameter of said upper portion of said side enclosure; and a removable lid for said jar which seals said opening, said lid including a top wall disposed about the central axis, an encircling member extending downwardly from said top wall and radially about the central axis, said encircling member including a screw thread which matingly engages with said screw thread of said upper portion of said side enclosure, a circular projection extending downwardly from said lid and radially about the central axis which engages and seals with said circular brim after said screw threads of said jar and lid engage, and a circular flexible flange extending downwardly from said lid and radially about and beyond said circular projection and the central axis, said flexible flange having a tip which is radially flexed relative to a remainder of said flange upon engagement with said curved upper wall of said jar to seal therewith as said circular projection and circular brim matingly engage.

2. A sealed container as claimed in claim 1 wherein said top wall of said lid includes a circular centering rim extending downwardly from said top wall and radially about the central axis just inside and downwardly beyond said circular projection such that before engagement of said circular projection with said circular brim said centering rim engages an inside surface of said circular brim to positively locate said circular projection vertically adjacent said circular brim.

3. A sealed container as claimed in claim 2 wherein said centering rim includes a lower outside surface which is inclined downwardly and inwardly.

4. A sealed container as claimed in claim 2 wherein said diameter of said circular brim is about $\frac{2}{3}$ of the diameter of said upper portion.

5. A sealed container as claimed in claim 2 wherein said side enclosure below said upper portion includes a holding recess therein.

6. A sealed container as claimed in claim 5 wherein said side enclosure is cylindrically shaped about the central axis.

7. A sealed container as claimed in claim 5 wherein a heat shrink label surrounds the base jar and the removable lid, said label including a line of perforations adjacent a gap provided between the bottom edge of said lid and said base jar such that said label serves as a tamper indicator.

8. A sealed container as claimed in claim 1 and further including a stacking means for stacking one said container vertically on another, said stacking means including (a) in said top wall of said lid, a top recess about the central axis and an outer downwardly bevelled portion surrounding said top recess, and (b) in said bottom wall of said base jar, a concavity having an exterior surface which mates with said bevelled portion of an underlying lid and stacking lugs projecting downwardly from the exterior surface of said concavity which are received inside of said top recess of the underlying lid.

9. A sealed container as claimed in claim 1 wherein said curved upper wall forms a dome.

10. A sealed container as claimed in claim 1 wherein said diameter of said circular brim is about $\frac{2}{3}$ of the diameter of said upper portion.

11. A sealed container as claimed in claim 1 wherein said side enclosure below said upper portion includes a holding recess therein.

12. A sealed container as claimed in claim 1 wherein a heat shrink label surrounds the base jar and the removable lid, said label including a line of perforations adjacent a gap provided between the bottom edge of said lid and said base jar such that said label serves as a tamper indicator.

13. A sealed container which is easily opened comprising:

a base jar for containing a substance, said jar including a bottom wall, a side enclosure extending upwardly from said bottom wall and including an upper portion disposed radially about a central axis with a screw thread about said upper portion, a curved upper wall extending inwardly and upwardly from said upper portion of said side enclosure and radially about the central axis, said upper wall including a circular brim which defines a mouth opening for said jar; and a removable lid for said jar which seals said opening, said lid including a top wall disposed about the central axis, an encircling member extending downwardly from said top wall and radially about the central axis, said encircling member including a screw thread which matingly engages with said screw thread of said upper wall of said jar, a circular projection extending downwardly from said lid and radially about the central axis which engages and seals with said circular brim after said screw threads of said jar and lid engage, a circular flexible flange extending downwardly from said lid and radially about said circular projection and the central axis, said flexible flange having a tip which is radially flexed relative to a remainder of said flange upon engagement with said curved upper wall of said jar to seal therewith as said circular projection and circular brim matingly engage, and a stacking means for stacking one said container vertically on another, said stacking means including (a) in said top wall of said lid, a top recess about the central axis and an outer downwardly bevelled portion surrounding said top recess, and (b) in said bottom wall of said base jar, a concavity having an exterior surface which mates with said bevelled portion of an underlying lid and stacking lugs projecting downwardly from the exterior surface of said concavity which are received inside of said top recess of the underlying lid, said top wall of said lid includes a circular centering rim extending downwardly from said top wall and radially about the central axis just inside and downwardly beyond said circular projection such that before engagement of said circular projection with said circular brim said centering rim engages an inside surface of said circular brim to positively locate said circular projection vertically adjacent said circular brim.

14. A sealed container as claimed in claim 13 wherein said upper wall is curved to form a dome.

15. A sealed container as claimed in claim 14 wherein said circular brim has a diameter which is 50 to 80% of a diameter of said upper portion of said side enclosure.

* * * * *